US006019258A

United States Patent [19]

Richard

[11] Patent Number: 6,019,258

[45] Date of Patent: Feb. 1, 2000

[54] PLATE CHANGE DEVICE FOR A METALLURGICAL VESSEL AND SET OF PLATES FOR THIS DRAWER

[75] Inventor: Francois-Noel Richard, Anatole, France

[73] Assignee: Vesuvius Crucible Company, Wilmington, Del.

[21] Appl. No.: 09/091,964

[22] PCT Filed: Dec. 18, 1996

[86] PCT No.: PCT/EP96/05685

§ 371 Date: Dec. 14, 1998

§ 102(e) Date: Dec. 14, 1998

[87] PCT Pub. No.: WO97/24201

PCT Pub. Date: Jul. 10, 1997

[30] Foreign Application Priority Data

Dec. 26, 1995 [FR] France ..... 95 15885

[51] Int. Cl.[7] ..... B22D 41/08

[52] U.S. Cl. ..... 222/600; 266/236

[58] Field of Search ..... 222/600, 590, 222/591, 603, 597; 266/236

[56] References Cited

U.S. PATENT DOCUMENTS 5,011,050 4/1991 Verel ..... 222/600

5,211,857 5/1993 Brinker ..... 222/600

*Primary Examiner*—Scott Kastler

*Attorney, Agent, or Firm*—James R. Williams

[57] ABSTRACT

Plate change drawer for a metallurgical vessel such as a continuous casting distributor (2). The drawer has a chassis (12) mounted under the metallurgical vessel, at least one fixed upper plate (18) and at least one replaceable lower plate (22), means of applying pressure to force the lower plate (22) against the fixed plate, the chassis (12) having guide means for receiving a lower replacement plate (22) alongside the lower plate (22) during pouring, and actuation means for bringing the lower replacement plate (22) in place of the plate during pouring. The upper fixed plate (18) and the lower replaceable plate (22) have identical polygonal peripheries and are offset angularly so that they do not overlap completely. The polygonal periphery of the plate is a square or a square with rounded corners.

11 Claims, 2 Drawing Sheets

PLATE CHANGE DEVICE FOR A METALLURGICAL VESSEL AND SET OF PLATES FOR THIS DRAWER

The invention concerns a plate change device for a metallurgical vessel such as a continuous casting distributor; the device has a chassis mounted under the metallurgical vessel, at least one fixed upper plate and at least one replaceable lower plate, pressure means for applying the lower plate against the fixed plate, the chassis having means of guidance for receiving a lower replacement plate alongside the lower plate during casting and actuation means for bringing the lower replacement plate in the place of the plate during casting.

TECHNOLOGICAL BACKGROUND

In the continuous casting of steel the metal is tranfered into successive vessels such as ladles and distributors. One or more tapholes are provided in the bottom of each container for casting the metal.

The flow can be regulated by different means such as plate closures, stopper rods or simply a calibrated nozzle.

Some applications call for protection of the molten metal from the surrounding air. A refractory protection tube is then fastened under the vessel to surround the stream of molten metal as it emerges from the pouring hole.

Whatever the type of pouring refractory used, these refractories wear out and have to be changed so that the casting can be continued with the same vessel. Various solutions are already known for exchanging refractories without interrupting the pouring. For example, Belgian Patent N° 214,385 describes a tube changing device.

In a device of this type the a fixed plate. A lower plate combined with a protection tube is laid against the fixed plate to assure a tight joint.

When this plate and the protection tube associated with it have to be replaced, the plate of a new plate/tube assembly is placed alongside the plate to be changed and pushed by adequate means. The new plate expels the worn plate and takes its place.

To assure a perfect alignment of the upper face of the lower plate with the lower face of the upper plate, the fixed upper plate is generally longer than the lower plate at least on the side of introduction of the replacement plate so that the new plate can be introduced against the end of the upper plate when the plate to be replaced is still in the pouring position.

These places are frequently surrounded with a metal envelope. The use of a metal envelope makes it possible to obtain a plate ready for use, the outside dimensions of which are well-defined and which has resistant integrated sliding and support surfaces.

The metal envelope also permits maintaining the cohesion of the refractory material when cracks appear under the effect of thermal and mechanically elevated stresses induced by the casting conditions.

Exposition of the technical problem

Because the upper plate is longer, it is also more costly to produce.

On the other hand, the fact that the dimensions of the plates are different necessitates the management of different components, particularly when the refractory plates are surrounded by a metal envelope, the production of which requires a costly investment in tooling equipment. The purpose of the present invention is a plate changing device that resolves these disadvantages.

According to the invention, the upper plate and the lower plate have identical polygonal peripheries and are angularly offset so that they do not overlap completely.

Thus, the surface of the fixed plate directed toward the replacement plate that is not covered by the plate during pouring can serve as a guide surface for the replacement plate. Thus, although the surfaces of the plates are equal, we have a guide surface that permits a perfect alignment of the upper face of the lower plate with the lower surface of the upper plate.

Furthermore, the same metal envelope can be used for the two types of plates, also in the case where their internal constitution is different. The cost of the tooling equipment necessary for producing the metal envelopes is cut in half.

Preferably, the polygonal periphery of the plates is a square and a pouring orifice is placed in the center of the square.

Also preferably, the fixed plate and the replaceable plate are offset angularly by 45°. Preferably, the two surfaces lateral to the direction of introduction of the plates of the fixed plate which are never covered by the lower plate, either when the plates are in the casting position or during the changing of plates, are used to fix it on the device chassis, for example, by means of screws with a conical end, each acting on one edge of the fixed plate situated in the lateral zone not covered by the lower plate, these edges being situated at the front of this fixed plate with respect to the direction of introduction of the replacement plates in order to move the fixed plate simultaneously towards the back and against the drawer chassis.

This assures that during successive plate changes the upper plate will remain fixed and the joint between the upper plate and the well block or inner nozzle will not be damaged.

BRIEF DESCRIPTION OF THE DRAWINGS

Other characteristics and advantages of the present invention will become evident in reading the following description with reference to the attached figures.

Figure 1:
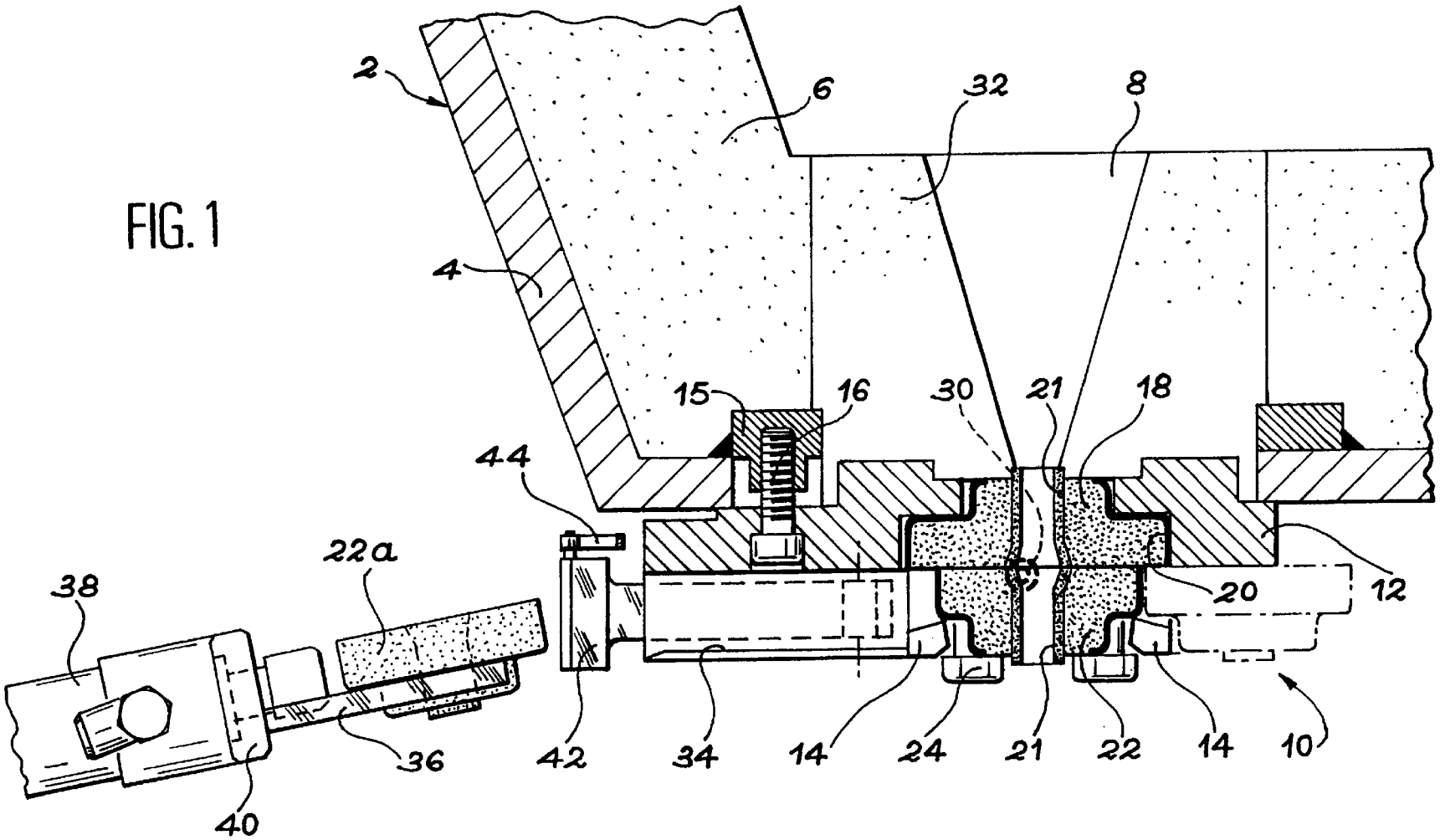
FIG. 1 is a longitudinal cross sectional view of a plate changing device in accordance with the invention.

On FIG. 1 a distributor 2 has a bottom wall of steel 4 covered with a protective layer of refractory material 6. A pouring orifice or taphole 8 is effected in the bottom of the distributor 2. A plate changing device designated as a whole by the general reference 10 is mounted under the distributor 2. A ring 14 is welded inside of the distributor on the bottom wall. Screws 16 fasten the chassis 12 of the device on this ring 14. A fixed refractory plate 18 is placed in a seat 20 of the chassis 12. A lower plate 22 is located under the fixed plate 18. The plate 22 is applied against the fixed plate 18 by means of pressure application constituted in the example shown by four rocker arms 24. As can be seen of FIG. 2, each rocker arm has one end applied on the lower face of the lower plate 22, and one end 24*b* pressed downward by a helical spring 26.

Essentially at its central part the rocker arm 24 is articulated on a bolt with a spherical head 28. The action exerted on the lower plate by these means of pressure application makes it possible to effect a tight junction of the fixed plate 18 and the lower plate 22.

Figure 2:
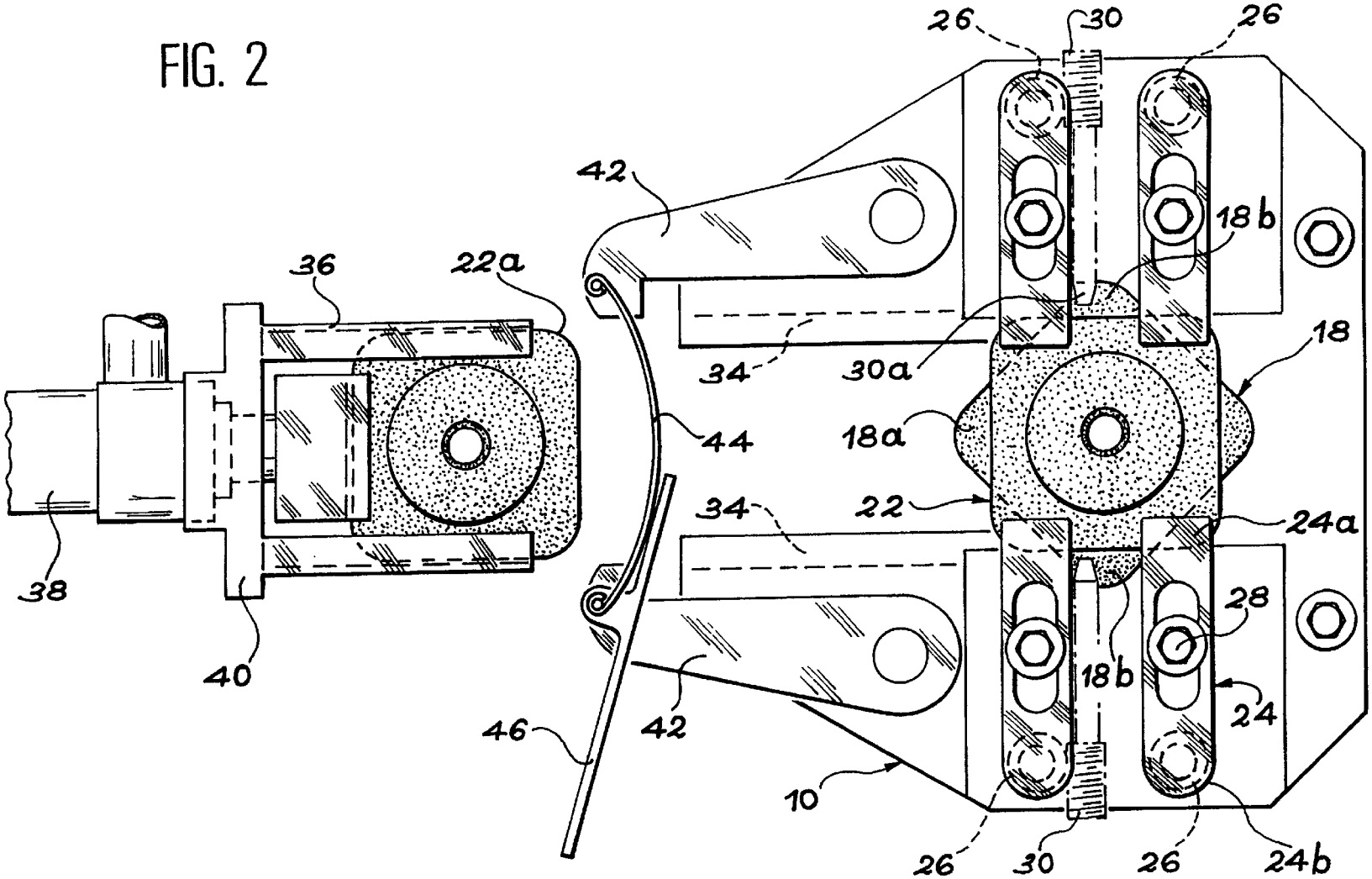
FIG. 2 is a bottom view of the plate changing device shown in FIG. 1.

As can be seen on FIG. 2, the fixed plate 18 and the lower plate 22 have identical peripheries, i.e, of the same shape and the same surface.

The fact that the plates 18 and 22 have identical peripheries is advantageous because this permits use of the same metal envelopes for these two plates. In this manner a single tooling outfit is sufficient. The investment required is thus cut in half.

The plates are preferably square. For practical reasons, notably of manufacture, the angles of the squares are rounded. The fixed plate 18 and the lower plate 22 have a pouring orifice 21. This taphole is placed in the center of the square periphery.

It is also noted that the fixed plate 18 and the lower plate 22 are angularly offset. In this manner, their surfaces are not covered completely. More particularly, the surface of the fixed plate 18 is not covered completely by the lower plate 22.

At the front of the fixed plate 18 with respect to the direction of introduction and exchange of the plates there is a triangular zone (the vertex of which is rounded) 18*a*. Apart from a plate exchange, this zone is not covered by the lower plate 22. It can thus be used as a guide surface for the replacement plate. Thus, although the surfaces of the plates are equal, there is a guide surface that permits a perfect alignment of the upper face of the lower plate with the lower face of the upper plate.

On either side of the plate 18, laterally with respect to the direction of plate change. there are two zones 18*b*, triangular in shape with a rounded end. These two zones are never covered by the lower plate 12, even during a plate exchange. These zones 18*b* can thus be used to maintain the fixed plate 18 towards the bottom of the seat 20 and towards the back of the frame 22. For this, the fixed plate is held in its seat 20 by two screws 30 that have a conical head 30*a*. The conical end 30*a* of each of the two screws 30 acts on an edge of the fixed plate 18 located in zone 18*b*, at the front of this zone with respect to the direction of introduction of the plates. The conical ends exert an action that applies the plate 18 toward the bottom of the seat 20, i.e., upward, and simultaneously an action that applies the fixed plate 18 towards the back of the frame 12 with respect to the direction of introduction of the plates.

It is advantageous to apply the fixed plate 18 toward the back of the frame to avoid a backlash between the plate 18 and the back corner of the seat 20 when the plates are exchanged. In effect, this backlash, even minimal, would have the effect of impairing the quality of the joint between the fixed plate 18 and the well block or inner nozzle 32 located in the thickness of the refractory lining 6 of the distributor 2. The screws 30 make it possible to eliminate this play.

In an alternative embodiment, the periphery of the fixed plate 18 has elastic means placed on two sides adjacent to an angle of the square periphery. These elastic means, comprising for example on elastic fibers or cardboard, are located at the time of assembly of the plate 18 in its seat 20 toward the front of the frame so as to automatically position the two opposite sides of the square against rigid supports effected in the chassis 12 for receiving them.

The chassis 12 has a guide means that permits receiving a lower replacement plate 22*a* along side the lower plate 22 during casting. In the exemplary embodiment shown the guide means are comprised of a slide rail 34 (see FIG. 2) located toward the front of the machine with respect to the direction of introduction of the replacement plate 22*a*. The plate 22*a* is mounted on a support 36. Actuation means comprised, for example, of a hydraulic or pneumatic cylinder 38 are connected to the support 36.

First, the lower replacement plate 22*a* is introduced into the slide rails 34 until the crosspiece 40 that is part of the means of support is retained behind two arms 42 articulated on the chassis 12. The two arms 42 are connected by an elastic means 44. When the support 36 carrying the replacement plate 22*a* is introduced, the articulated arms pivot around their axis so that their ends are separated. When the support 36 is introduced sufficiently into the guide means 34, the ends of the articulated arms 42 will lock on the crosspiece 40. At this time the replacement plate 22*a* is essentially in contact with the lower plate 22 in the pouring position. The actuation means 38 are then set in motion to expel the plate during pouring to replace it with the new plate 22*a*. The position shown in FIG. 1 is then occupied. The worn lower plate falls by itself out of the guide means.

The operator then acts on a lever arm 46 that deflects the two articulated arms 42 to free the support 36 and the crosspiece 40 and equip it with a new replacement plate.

What is claimed is:

1. Refractory plates and a plate change device for a metallurgical vessel, the device having a chassis (12) mounted under the metallurgical vessel, at least one fixed upper plate (18) and at least one replaceable lower plate (22) said upper plate (18) and said lower plate (22) having a pouring orifice (21), means for applying pressure to force the lower plate (22) against the fixed plate, the chassis (12) having a front and guide means for receiving in the front a lower replacement plate (22*a*) alongside the lower plate (22) during pouring, and actuation means for bringing the lower replacement plate (22*a*) in the place of the replaceable lower plate (22) during pouring, wherein the upper fixed plate (18) and the lower replaceable plate (22) have identical polygonal peripheries and are offset angularly so that the upper fixed plate and replaceable lower plate do not overlap completely.

2. The refractory plates and plate change device according to claim 1, wherein the polygonal periphery of the plates is substantially square.

3. The refractory plates and plate change device according to claim 2, wherein the plates have a center and the pouring orifice (21) is located at the center.

4. The refractory plates and plate change device according to claim 2, wherein the fixed plate (18) and the replaceable plate (22) are offset angularly by about 45° so that two zones (18*b*) of the fixed upper plate (18) lateral to the guide means are never covered by the lower plates (22, 22*a*).

5. The refractory plates and plate change device according to claim 4, wherein the two zones (18*b*) of the fixed plate (18) are used to fasten the fixed plate (18) on the chassis (12) of the device.

6. The refractory plates and plate chance device according to claim 5, wherein the device has two screws (30), each screw having a conical end (30*a*), each conical end acting on an edge of the fixed plate located in the zones (18*b*) not covered by the lower plate (22), each edge facing the front of the chassis so that the screws push the fixed plate away from the front and against the chassis (12) of the device.

7. A set of two plates in a plate change device of a metallurgical vessel comprising a fixed upper plate and a movable lower plate, each plate having a periphery and a working surface, the working surfaces in sliding contact, and the lower plate offset angularly from the upper plate in the device so that the lower plate can not cover two zones of the upper plate.

8. The set of two plates according to claim 7, wherein the peripheries are substantially identical squares.

9. The set of two plates according to claim 7, wherein the periphery of the upper plate has two adjacent sides and two opposite sides, the adjacent sides have elastic means that automatically position the opposite sides against rigid supports in the plate changer device.

10. The set of two plates according to claim 7, wherein at least one plate has a metal envelope surrounding at least the periphery.

11. The set of two plates according to claim 7, wherein at least one periphery has at least one rounded corner.

* * * * *